US006193558B1

(12) United States Patent
Yang

(10) Patent No.: US 6,193,558 B1
(45) Date of Patent: Feb. 27, 2001

(54) CIGARETTE LIGHTER ADAPTER WITH SECURING RING

(75) Inventor: Sung Ook Yang, Union City, CA (US)

(73) Assignee: Advanced Mobile Solutions, Inc., Moraga, CA (US)

( * ) Notice: Subject to any disclaimer, the term of this patent is extended or adjusted under 35 U.S.C. 154(b) by 0 days.

(21) Appl. No.: 08/951,071

(22) Filed: Oct. 15, 1997

(51) Int. Cl.[7] ..... H01R 25/00
(52) U.S. Cl. ..... 439/638
(58) Field of Search ..... 439/638, 668; 320/105

(56) References Cited

U.S. PATENT DOCUMENTS 5,201,677 * 4/1993 Takayama ..... 439/668
5,261,838 * 11/1993 Fujie ..... 439/668
5,431,585 * 7/1995 Fan ..... 439/668
5,704,812 * 1/1998 Moji ..... 439/668

* cited by examiner

*Primary Examiner*—Neil Abrams
*Assistant Examiner*—T C Patel
(74) *Attorney, Agent, or Firm*—Nathan P. Koenig; Crosby, Heafey, Roach & May

(57) ABSTRACT

A cigarette lighter adapter formed from two complementary members that form a cylindrically shaped housing having an axial end with an annular recess, and a ring that fits within the annular recess and secures the two complementary portions together. The ring is configured to fit entirely within the annular recess and to fill the recess completely, making removal without destroying the ring or the housing virtually impossible. Preferably, the ring is configured to snap fit into the annular recess. Additional means for securing the two members may also be provided, preferably at a location removed from the first axial end.

8 Claims, 2 Drawing Sheets

CIGARETTE LIGHTER ADAPTER WITH SECURING RING

FIELD OF THE INVENTION

This invention relates to electrical connecting devices, particularly to a tamper resistant, tamper evident electrical adapter plug that may be manufactured easily and cheaply.

BACKGROUND OF THE INVENTION

In recent years, a great variety of electrical appliances have become available for operation by the low voltage power of direct-current electrical systems found in vehicles. Such appliances are generally interconnected to the electrical system by use of an adapter plug or connector, which is inserted into a cigarette lighter socket or receptacle. Electrical appliances and accessories that can be operated from a vehicle electrical system include battery chargers, portable televisions, cellular phones and the like. Demand for portable electronic devices makes it quite desirable to provide such appliances with a cigarette lighter adapter (CLA) to give users the option of powering these devices with the automotive electrical system.

Important qualities in CLAs designed for consumer use are ease, speed and reliability of manufacturing in addition to an end product that is sturdy and resists tampering by the consumer. CLAs that are easily disassembled by the consumer create problems including safety risks, difficulty in making requested repairs, and uncertainty in determining cause of defects. For example, a CLA that may be easily disassembled increases the probability that the consumer will attempt to repair or modify the device, which could lead to wiring misconnections and other safety concerns. An easily disassembled CLA also increases the probability that a part will be lost. Finally, if the consumer is able to disassemble the device, it can be impossible to determine the nature of the fault since the consumer may have altered the CLA's configuration before returning it for repair.

The prior art offers a number of ways to manufacture CLAs, but all suffer from certain disadvantages. For ease of manufacture and economy, CLAs are usually made from thermoformed plastics. Generally, the CLA comprises two halves that house the wiring components and electrical contacts. Simple methods for securing these two halves include using screws or configuring the parts so that they snap fit. However, the use of screws increases the manufacturing time, snap fit connections are relatively weak, and both systems are easily disassembled by the user. Anti-backout screws may be used to prevent disassembly, but still increase the time of manufacture and are expensive. Additionally, the configuration of the CLA makes it difficult to provide screw locations in the barrel due to space considerations and the possibility of shorting out the electrical connections.

An alternative strategy involves gluing the halves together. While such CLAs have the advantage of being tamper resistant, the curing time of the adhesive dramatically slows the manufacturing process. Moreover, quality control issues are exacerbated as gluing can often result in poor cosmetic results. Ultrasonic bonding can provide better results, but it has been found that bonding small, cylindrical objects is difficult. Indeed, attempts to use ultrasonic bonding in the manufacture of CLAs have resulted in a success rate of less than 50%, which is obviously unacceptable.

Finally, other known means of securing the pieces of a CLA have proven deficient for various reasons. For example, screw-on tips have been used to secure the CLA pieces, but the means of attachment is easy to disassemble and the screw-on tip can be lost. External collars have also been used, but they also can be easy to remove. Further, they are not compatible with flat-nosed CLAs that interface with the securing springs of modern cigarette lighters.

Accordingly, there is a need for a process of manufacturing CLAs that is fast and economical. There is also a need for producing CLAs that resist disassembly by the user in order to maximize safety and reliability. This invention satisfies these and other needs.

SUMMARY OF THE INVENTION

This invention is a cigarette lighter adapter plug formed from two complementary portions that together form a cylindrically shaped housing having an axial end with an annular recess, and a ring that fits within the annular recess and secures the two complementary portions together. The ring is configured to fit entirely within the annular recess and to fill the recess completely, making removal without destroying the ring or the housing virtually impossible. Preferably, the ring is configured to snap fit into the annular recess. Additional means for securing the two halves may also be provided, preferably at a location removed from the axial end.

DETAILED DESCRIPTION OF THE PREFERRED EMBODIMENT

Figure 1:
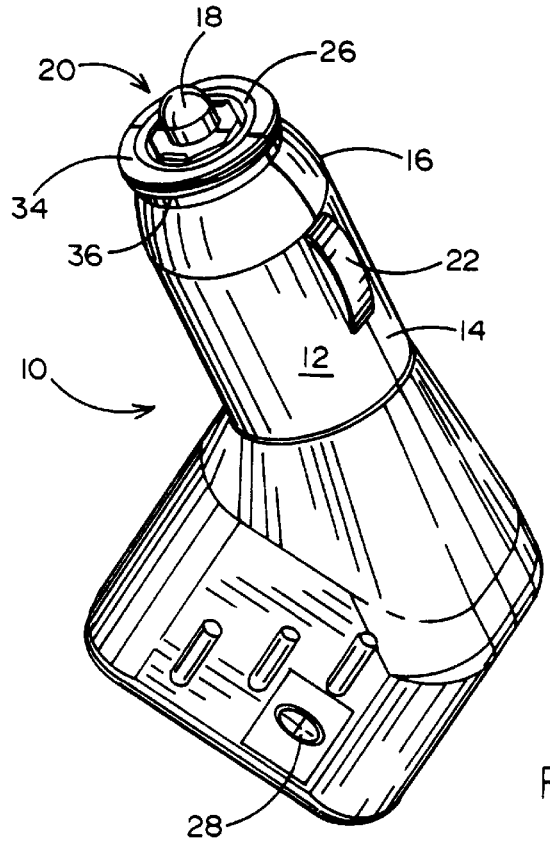
FIG. 1 is an isometric view of a cigarette lighter adapter embodying features of the invention showing the assembled housing members secured by the ring.
Figure 2:
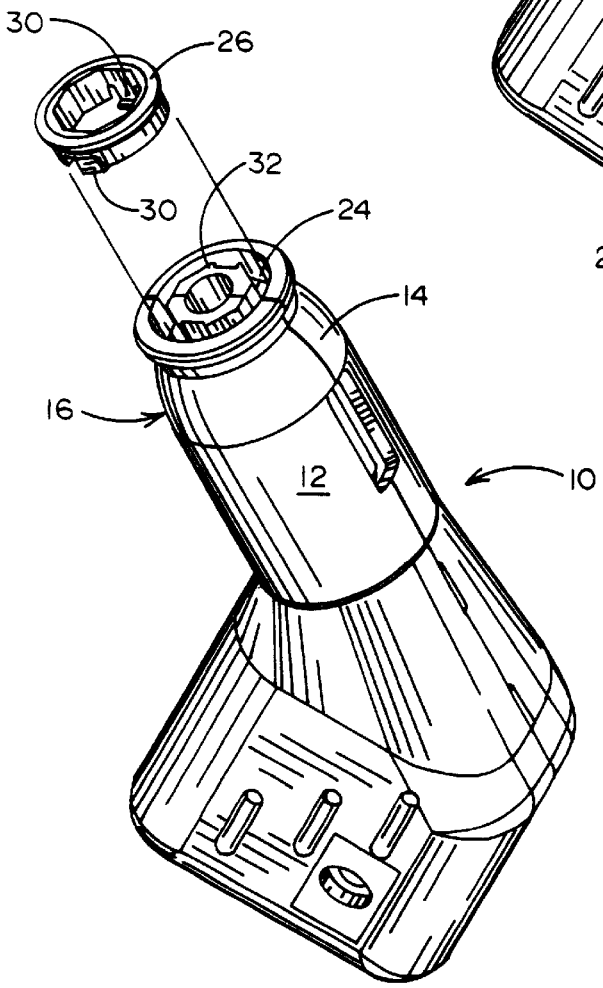
FIG. 2 is an isometric view showing the two housing members and the recess for accepting the inset ring.

FIGS. 1 and 2 illustrate cigarette lighter adapter 10 of the invention, comprising two housing members 12 and 14 that form cylindrical plug 16. Contact 18 at the axial end 20 of plug 16 and contact 22 on the radial surface of plug 16 are configured to electrically connect with the contacts in the housing of a conventional cigarette lighter (not shown). Annular recess 24 is formed when housing members 12 and 14 are mated together. Inset ring 26 fits into recess 24, securing housing members 12 and 14 together. Screw 28 provides additional securing power, but alternative means may also be suitable, such as configuring the housing members to snap fit.

Figure 4:
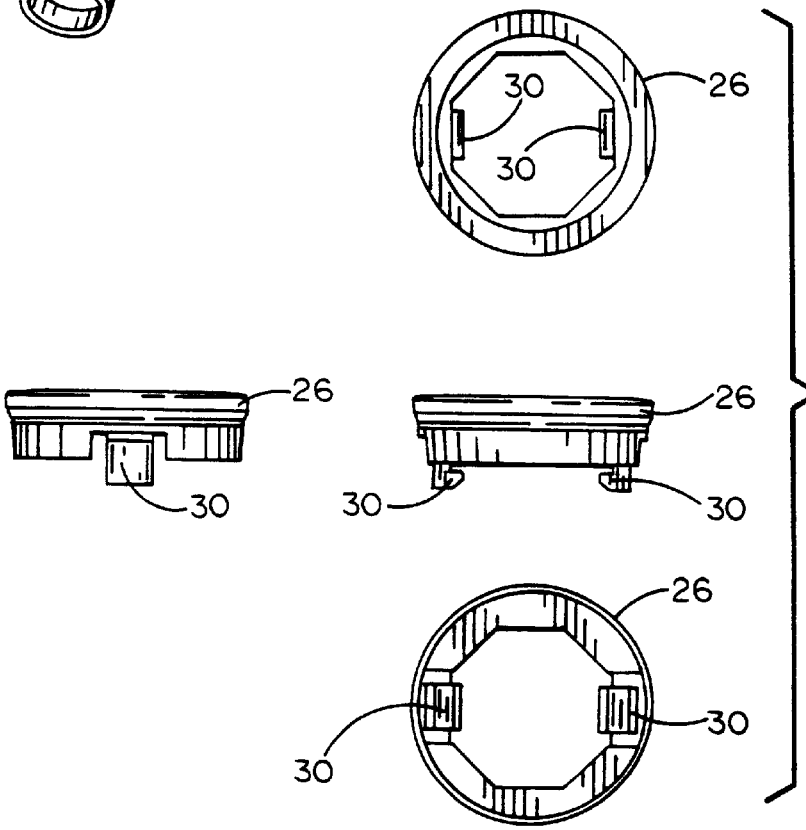
FIG. 4 is a side view detailing features of an inset ring of the invention.

As shown in FIGS. 2 and 4, inset ring 26 is configured to closely conform to annular recess 24, so that it fits entirely within the recess, filling it completely. This makes the ring 26 difficult or impossible to remove without destroying the CLA. Prongs 30 mate with complementary hooks in the housing (not shown) to provide a simple snap fit attachment. However, because the ring 26 encircles projections 32 of the housing members 12 and 14, the use of ring 26 to secure the members together is much stronger than conventional snap fit arrangements. Indeed, drop testing has demonstrated that this means of attachment is simple, but extremely reliable. Because the ring 26 cannot be removed without damaging it or the housing, the CLAs of this invention are both tamper resistant and tamper evident.

Another advantage of the securing ring of this invention is that it is compatible with the modern design of cigarette lighters which have a spring retention system that holds the CLA more securely. As shown in FIG. 1, the axial end 20 of plug 16 features a flat face 34 and narrowed neck 36 which interacts with the spring retention system of modern cigarette lighters. Note that ring 26 does not interfere with this system which distinguishes it over prior art systems having a screw-on tip or an external collar.

Figure 3:
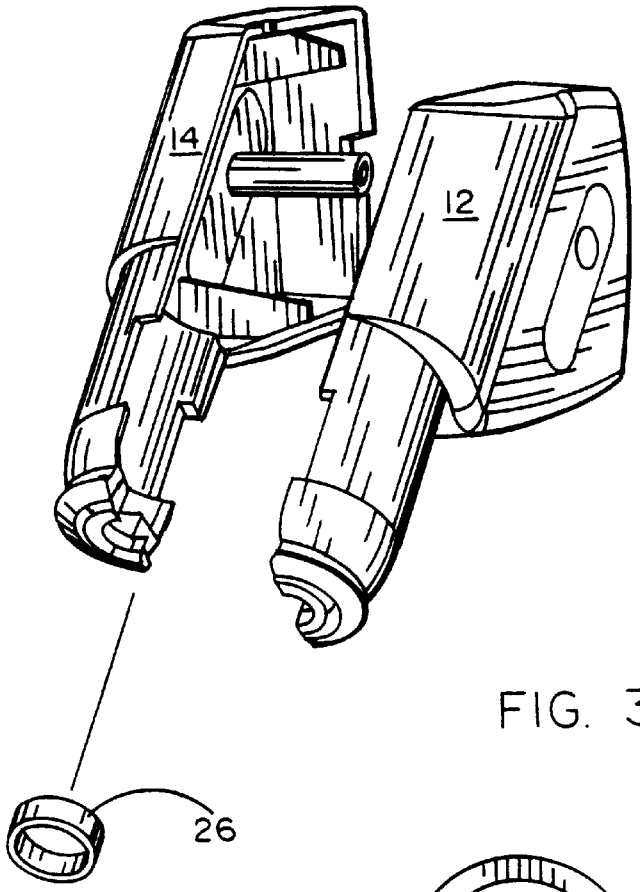
FIG. 3 is an exploded, isometric view of a CLA of the invention.

FIG. 3 shows CLA 10 in exploded view, detailing the relation between housing members 12 and 14 and securing ring 26. FIG. 4 details various elevations of securing ring 26, showing the preferred configuration having prongs 30 to provide a snap fit connection to annular ring 24.

A general description of the device of the present invention as well as a preferred embodiment of the present invention has been set forth above. One skilled in the art will recognize and be able to practice many changes in many aspects of the device described above, including variations that fall within the teachings of this invention. The spirit and scope of the invention should be limited only as set forth in the claims which follow.

What is claimed is:

1. A cigarette lighter adapter plug comprising two complementary members that together form a cylindrically shaped housing having an axis and a face with an annular recess generally perpendicular to the axis at an axial end thereof, and a ring that fits within the annular recess and secures the two complementary members together.

2. The cigarette lighter adapter of claim 1, wherein the securing ring is configured to completely fill the annular recess.

3. The cigarette lighter adapter of claim 1, wherein the securing ring is configured to fit completely within the annular recess.

4. The cigarette lighter adapter of claim 1, wherein the securing ring is configured to irreversibly snap fit within the annular recess.

5. The cigarette lighter adapter of claim 1, wherein the axial end has a flat face configured to mate with a spring retention system of a cigarette lighter socket.

6. The cigarette lighter adapter of claim 5, wherein the securing ring is configured to completely fill the annular recess.

7. The cigarette lighter adapter of claim 5, wherein the securing ring is configured to fit completely within the annular recess.

8. The cigarette lighter adapter of claim 5, wherein the securing ring is configured to irreversibly snap fit within the annular recess.

* * * * *